United States Patent [19]

Regitz

[11] 4,170,468

[45] Oct. 9, 1979

[54] DEOXIDATION OF STEEL

[75] Inventor: Lester J. Regitz, Penn Township, Westmoreland County, Pa.

[73] Assignee: United States Steel Corporation, Pittsburgh, Pa.

[21] Appl. No.: 863,115

[22] Filed: Dec. 22, 1977

[51] Int. Cl.[2] ..... C21C 7/06

[52] U.S. Cl. ..... 75/58; 148/120

[58] Field of Search ..... 75/58; 148/120

[56] References Cited

U.S. PATENT DOCUMENTS

| | | | |
|---|---|---|---|
| 3,819,426 | 6/1974 | Decaro et al. | 148/120 |
| 3,990,887 | 11/1976 | Hisada | 75/58 |

*Primary Examiner*—M. J. Andrews

*Attorney, Agent, or Firm*—Forest C. Sexton

[57] ABSTRACT

Molten steel is deoxidized while it is being tapped into a receiving vessel by sequentially adding at least three separate deoxidizing agents in order of increasing deoxidizing strength. The additions are suitably spaced to allow each to mix and react before the next addition is made.

23 Claims, No Drawings

DEOXIDATION OF STEEL

FIELD OF INVENTION

This invention relates generally to a process for deoxidizing molten steels which minimizes finely-dispersed non-metallic inclusions in the steel. More specifically, this invention relates to a method for deoxidizing steel intended for low-carbon electrical sheet applications whereby a greatly reduced amount of finely-dispersed non-metallic inclusions permit enhanced magnetic permeability in the product.

BACKGROUND OF THE INVENTION

Because of their superior magnetic properties, silicon sheet steels are widely used in the production of magnetic core components in electrical equipment such as motors, generators, transformers, and the like. These favorable magnetic properties, namely high magnetic permeability, high electrical resistance and low hysteresis losses, will minimize wasteful conversion of electrical energy into heat, and will therefore permit manufacture of electrical equipment having greater power and efficiency. In order to effect and optimize the desired magnetic properties, however, the silicon sheet steels must be produced under carefully controlled and exacting processing parameters. Silicon sheet steels are therefore substantially more expensive than other more conventional flat rolled steel products.

In the high volume manufacture of small electrical equipment for consumer appliances, toys and the like, unit cost is perhaps the most important consideration, far outweighing equipment efficiency and power considerations. For these applications, therefore, electrical equipment manufacturers frequently utilize the less expensive, more conventional low-carbon sheet steels for magnetic core components. Hence, there is a considerable market for low-carbon sheet steels having acceptable magnetic properties for magnetic core applications.

In the course of producing low-carbon sheet steels for magnetic applications, economic considerations have dictated that expensive processing steps be avoided and that even inexpensive steps be minimized. Therefore, even though elaborate processes have been developed for producing low-carbon sheet steels having exceptional magentic properties, such processes have not been adapted commercially, because the use of such processes would greatly add to the cost of the product, while not improving the magnetic properties of the resultant sheet sufficiently to equal those of silicon sheet steels having comparable cost of production. To be of any commercial value, therefore, any new process for improving the magnetic properties of low-carbon sheet steels must be one that will not significantly increase the steel's production cost. Commercially, therefore, low-carbon sheet steels for magnetic applications are produced from conventional low-carbon steel heats having less than 0.1 percent carbon and the usual residual elements at normal levels for cold-rolled products. The rolling procedures are similar to those used for other cold-rolled products. Specifically, the production steps are usually limited to hot rolling a low-carbon ingot to slab form; hot rolling the slab to sheet form; pickling the hot rolled sheet, cold rolling the pickled sheet for a reduction of 40 to 80 percent, and annealing the sheet to effect recrystallization, generally in a box annealing furnace. An optional final temper roll of from ½ to 2 percent is sometimes provided for the purpose of flattening the resultant sheet and make it better suited for subsequent slitting and punching operations. Alternately, more recent developments have shown that temper rolling from 7 to 9% will not only impart the desired flatness and punchability characteristics, but will also improve the magnetic properties, as disclosed in U.S. Pat. No. 3,923,560.

The commercially produced low-carbon sheet steels for magnetic applications, when rolled to 18.5 mils thickness, typically exhibit permeabilities in the rolled direction of from 5000 to 6000 at 10 kilogauss, with core losses of from 1.3 to 1.6 watts/lb. For the same thickness at 15 kilogauss, permeabilities in the rolled direction typically range from 2000 to 4000 with core losses of 3.0 to 4.0 watts/lb. Sheets rolled to 25 mils typically exhibit permeabilities in the rolled direction of from 4200 to 4800, with core losses of 1.8 to 2.0 watts/lb. and 10 kilogauss; and permeabilities in the rolled direction of from 2000 to 3000 with core losses of 4.2 to 4.8 watts/lb. at 15 kilogauss.

These relatively wide ranges in magnetic properties reflect an established tendency on the part of industry to deemphasize magnetic properties in low-carbon sheet steel and emphasize low cost of production. Nevertheless, customers have recently begun to demand improved magnetic properties, particularly at 15 kilogauss, without an appreciable increase in cost. As noted above, producers have been hard pressed to improve magnetic properties in these steels without substantial increases in production costs.

Recently developed low-carbon sheet steels have shown marked improvement in core loss values. Specifically, exceptionally low-carbon steels, i.e. 0.01 to 0.02% carbon, having manganese and phosphorus contents of about 0.5 to 1% and 0.12 to 0.18% respectively, can be processed to produce 15 kg core loss values of 2.3 to 2.7 watts per pound when rolled to 18.5 mils thickness. Unfortunately, however, the 15 kg permeabilities for these steels, typically within the range 1800 to 2000, are not superior to many of the low-carbon electrical sheet steel available prior thereto. Although these newer steels have achieved a considerable degree of commercial success, based on their superior core loss characteristics, they have not been acceptable in those applications wherein good permeability is also essential or of prime consideration.

SUMMARY OF THE INVENTION

This invention is predicated upon my conception and development of a unique process for deoxidizing molten steel which will minimize finely-dispersed non-metallic inclusions in the resulting product. The process involves the sequential addition of several deoxidizing elements, starting first with the one having the least affinity for oxygen and then waiting for a predetermined period of time to allow substantially complete reaction thereof and then adding another deoxidizer having a somewhat greater affinity for oxygen, and so on. When utilized in the production of low-carbon sheet steels, this process will provide a product having substantially enhanced magnetic permeability. It should be recognized, moreover, that because of the reduced amount of finely-dispersed non-metallic inclusions resulting from the practice of this process, this process would have much broader application beyond that of producing electrical sheet steels. For example, reduced non-metallic inclusions would be of obvious benefit in cold working or deep drawing steels, among others where non-metallic inclusions are known to be detrimental.

Accordingly, a primary object of this invention is to provide an improved process for deoxidizing molten steels which results in reduced amount of finely-dispersed non-metallic inclusions.

Another object of this invention is to provide a process for deoxidizing molten steel which will provide enhanced magnetic permeability in sheet products rolled therefrom.

Still another object of this invention is to provide a process for producing an improved low-carbon sheet steel for magnetic applications.

A further object of this invention is to provide an improved low-carbon electrical sheet steel having 15 kg core losses within the range 2.3 to 3.15 watts/lb., and 15 kg permeabilities of from 2000 to in excess of 3000 in 18.5 mil sheet, as tested in conventional manner, using half longitudinal and half transverse Epstein packs.

DESCRIPTION OF THE PREFERRED EMBODIMENTS

In its broadest aspect, the process of this invention involves a unique practice for deoxidizing a heat of steel, preferably while the steel is being tapped from the steelmaking vessel, or in any event, while the molten steel is being transferred from one vessel to another. The process requires the consecutive addition of at least three successively stronger deoxidizing elements to the ladle or vessel while such vessel is being filled during the tap. The rate of flow of steel being tapped or transferred must be controlled to allow a suitable time interval between the additions so as to allow substantially complete reaction of each deoxidizer with dissolved oxygen in the steel and with previously formed oxides, either dissolved or precipitated. It is believed that the oxidation products so formed are large agglomerations of multiple oxides such that they readily float to the surface, thereby reducing to an appreciable extent oxide inclusions within the body of the steel, and in any case greatly reducing the amount of finely-dispersed deoxidation products in the cast product.

A more specific application of this process has been utilized in commercial operations for producing low-carbon electrical sheet steel, with the effect being that it has caused the resultant steel to have very substantially enhanced magnetic permeability values. In this preferred practice of this invention, the process is utilized in conjunction with a process for producing high-quality, low-carbon electrical sheet steel. This steel is usually refined in a bottom-blown oxygen refining vessel, so as to achieve a final carbon content of from 0.01 to 0.02%, a final sulfur content of up to 0.015% and then the chemistry of the heat adjusted to provide 0.5 to 1.0% manganese and 0.12 to 0.18% phosphorus. In prior art practices, this steel was not deoxidized, but teemed in accordance with conventional rimmed steel practices. Slabs of this steel are hot rolled to hot-band gage with a finishing temperature of 1550° to 1600° F., coiled at below 1050° F., pickled, cold-rolled and temper-rolled or stretcher-leveled from 2 to 9%. Pursuant to this invention, the above steel is now deoxidized as it is tapped from the steelmaking vessel to effect substantially enhanced magnetic permeability.

According to one embodiment of this new practice, the steel is refined, as before to provide a carbon content below 0.02%, and a sulfur content below 0.015%. Because these levels are exceptionally low, it is preferred that the steel be refined in a Q-BOP refining vessel, i.e. a bottom-blown oxygen vessel wherein such levels can be readily obtained. Otherwise, additional processing steps may be required, such as ladle desulfurization and vacuum carbon deoxidation or subsequent solid-state decarburization. Nevertheless, the practice of this invention can be accomplished in combination with conventional BOP steelmaking facilities or with electric furnaces if suitable care is exercised during steelmaking, or subsequent treatments to assure the desired composition. When the desired chemistry is achieved, the refined steel is tapped into a ladle. Prior to tapping, and pursuant to conventional practices at some mills, a small amount of aluminum, i.e. 200–300 pounds, may be placed in the bottom of the empty ladle to "quiet" an otherwise "lively" heat. This aluminum addition is, of course, optional. To deoxidize the heat pursuant to this inventive process, tapping of the heat into the ladle is commenced and allowed to progress until the ladle is approximately one-fourth full. At this point, and without interruption of the tap, electrolytic manganese or low-carbon ferro-manganese is quickly added to the melt in the ladle. The amount of manganese added should be sufficient to achieve the desired final manganese content after deoxidation has been accomplished. Although either ferromanganese or electrolytic manganese can be used, electrolytic manganese is preferred for this embodiment for making electrical sheet since it is desirable that the carbon content be kept below 0.02%. After the manganese is added, tapping is continued until the ladle is approximately one-third full, whereupon silicon is quickly added without interruption of the tap. Preferably, a low-carbon ferrosilicon is added in an amount sufficient to provide a residual silicon content, after deoxidation, of between 0.04 and 0.10%. Tapping is still continued, and when the ladle is approximately one-half full, aluminum is added quickly, preferably "plunged" below the molten steel surface, in an amount sufficient to provide a residual aluminum content, after deoxidation, of between 0.004 and 0.05%. Tapping is of course continued, and when the ladle is approximately three-fourths full, lime is added for the purpose of protecting the surface of the deoxidized steel, fluxing and entrapping the oxide inclusions that have floated upward out of the molten steel. Such lime additions are conventional in prior art practices. Shortly thereafter, but before the tap is complete, sufficient low-carbon ferrophosphorus is added in an amount sufficient to provide the final desired phosphorus content of 0.12 to 0.18%. This phosphorus addition is not, of course, a part of the deoxidizing process, but is added in this specific embodiment because of the phosphorus content required in this particular grade of electrical steel. Although the above noted amounts of silicon and aluminum in the steel are not critical, they are preferred for optimum magnetic properties.

It is, of course, critical that the above sequence of addition be maintained, i.e. manganese, then silicon and finally aluminum, in order to provide the necessary increasing deoxidizing strength and that the combined amount of these deoxidizers be sufficient to deoxidize the steel heat and provide the residual levels as necessary to meet chemistry limits. The actual amounts of deoxidizing elements added will of course depend upon the oxygen content of the steel being tapped, and will therefore vary with the steelmaking facilities being used. A skilled operator however should not have difficulty in determining the amounts of additives necessary to deoxidize the steel and meet the desired composition levels. If other deoxidizers are used, they should of course be added in an order that each successive deoxidizer is stronger than the one preceding. Although the above timing interval is not particularly critical, it is obvious that intervals between the various additions must be sufficient to allow thorough mixing and reaction of each deoxidizer before the next one is added and that all additions be completed before tapping is complete to insure thorough mixing with the molten steel. Although I have developed no rigid rules regarding interval spacing, I have tried to provide at least 30 seconds between additions, and this has proven to be satisfactory. In view of this need for some interval between additions, it is obvious that the tapping should not be allowed to progress too rapidly. As a rule of thumb, the tapping rate should be sufficient to provide at least 4 minutes from commencement to completion, with the additions made at approximately equal space intervals. In the above specific embodiment wherein phosphorus is also added during the tap, a tap time of at least 5 minutes should be provided.

To complete the process for producing the improved low-carbon electrical sheet steel, the steel melt, deoxidized and rephosphorized as described above is either continuous cast to slab form, or cast as ingots and the ingots hot rolled to slab form. The slabs are then hot-rolled to hot-band gage, i.e. 0.070 to 0.130-inch, with a finishing temperature within the range 1550° to 1600° F. and then coiled at a temperature below 1050° F. This will of course require some water-spray cooling on the run-out table following the last stand before the steel is coiled. The coiled steel is then pickled in conventional pickling solutions, such as hydrochloric or sulfuric acid, to remove mill scale and then cold rolled to the desired final gage, usually 0.018 to 0.036-inch. After cold rolling, the steel is box annealed . . . at between 1100° and 1300° F. for a sufficient time to insure that all portions of the coil is heated to the indicated temperature for a minimum period of one hour, or continuously annealed by any of the variety of continuous annealing processes as necessary to effect recrystallization, and then finally elongated from 7 to 9%, preferably pursuant to the temper rolling practice as claimed in U.S. Pat. No. 3,923,560. Although such an elongation procedure is not absolutely essential, it is preferred in order to achieve optimum magnetic properties. If suitable temper rolling facilities are not available, the steel may be elongated to the specified extension by a combination of temper rolling and stretching operation, as by stretch-roller-leveling. However, deformation by such stretching is not as effective in promoting optimum magnetic properties as is temper rolling.

EXAMPLE

To illustrate a specific example of the above described process, a commercial heat of steel was made in a bottom-blown oxygen vessel pursuant to conventional practices. The heat was made-up of 276,900 pounds of molten blast furnace metal and 190,000 pounds of cold scrap. The blast furnace metal contained 0.273% manganese, 1.351% silicon, 0.022% sulfur and 0.154% phosphorus. The steel was made by blowing oxygen through the bath for 12.3 minutes, with the simultaneous injection of 26,050 pounds of burnt lime. The bath was reblown twice; once for 12 seconds, and subsequently for 58 seconds, again with burnt lime injection. After the second reblow, the bath temperature was 2900° F., and the steel composition was shown to be 0.012% carbon, 0.0149% sulfur, 0.032% manganese, 0.007% phosphorus, 0.008% silicon, 0.015% copper, 0.001% nitrogen and 0.004% chromium. Prior to tapping this heat, 300 pounds of aluminum was placed in the bottom of the tap ladle. Thereafter, the steel was slowly tapped into the tap ladle. After 70 seconds of tap time, when the ladle appeared to be about ⅓ full, 3500 pounds of low carbon ferromanganese containing 93% Mn, balance Fe, was added to the metal in the ladle without interrupting the tap. When tapping had continued for 2 full minutes and the ladle appeared to be about ½ full, 800 pounds of ferrosilicon, containing 50% silicon, was added as quickly as possible using a shaker mechanism, again without interruption of the tap. The shaker mechanism permits a charge therein to be deposited continuously, over a period of time, by a vibratory agitating action and consumed 50 seconds to add all the ferrosilicon. After a total tap time of about 3¼ minutes, approximately 30 seconds after the last of the ferrosilicon had been added, an additional 300 pounds of aluminum was added without interruption of the tap. This aluminum addition was plunged into the melt by throwing baled aluminum ingots into the feed chute. At about 4½ minutes of total tap time, 800 pounds of "pebble" lime was added. Finally, when the ladle appeared to be about ¾-full, at a total elapsed tap time of 6 minutes, 2370 pounds of ferrophosphorus was added to the ladle through the shaker mechanism. Tapping was continued until the ladle was full.

The ladle composition of the tapped steel was 0.02% carbon, 0.56% manganese, 0.135% phosphorus, 0.05% silicon and 0.007% aluminum.

Ingots cast from the above steel heat were hot rolled to 8-inch-thick slabs, and after reheating, subsequently rolled to 0.080-inch-thick hot rolled coils. The hot rolled coils were cold-rolled to 0.019-inch-thick sheet, which were box annealed at 1200° F. The box annealed coils were temper rolled 0.75%, and then stretch-roller-leveled to effect a total elongation of 4.5 to 5%. The resulting average magnetic properties are shown below compared to conventional cold-rolled motor lamination steel identically processed but for the deoxidation practice of this invention. All alloys were added to the comparison heat in an incontrolled manner early in the process of tapping.

| | 15 Kilogauss | |
|---|---|---|
| | Core loss (watts/lb) | Permeability |
| 0.0185-inch sheet, conventional | 3.07 | 1572 |
| 0.0185-inch sheet, deoxidized per this invention | 3.11 | 2311 |
| 0.024-inch sheet, conventional | 4.32 | 1968 |
| 0.024-inch sheet, deoxidized per this invention | 4.24 | 2627 |

With reference to the above example, it should be noted that this was the first commercial trial, and because of equipment limits, it was not possible to effect a 7 to 9% elongation. However, on subsequent production heats wherein a 7 to 9% elongation was effected, 15 kilogauss permeabilities in excess of 3000 have been realized with 18.5 mil product. With a little experience, operators have been able to consistently get 15 kilogauss core losses of less than 3.0 watts per pound, and well over 2000 permeabilities on 18.5 mill product.

I claim:

1. A method of deoxidizing molten steel to minimize finely-dispersed non-metallic inclusions therein, comprising while the steel is being tapped into a receiving vessel, sequentially adding to the steel in the receiving vessel at least three different deoxidizing elements in order of increasing deoxidizing strength in a combined amount sufficient to deoxidize said steel, said additions spaced by sufficient time intervals to permit each addition to mix and react with oxygen and oxides therein.

2. A method according to claim 1 in which said additions are made to tap ladle while said steel is being tapped from the steelmaking vessel thereinto.

3. A method according to claim 1 in which said deoxidizing elements comprise manganese, silicon and aluminum.

4. A method according to claim 1 in which said additions are made during a total tap time of at least 4 minutes.

5. A method according to claim 1 in which the first deoxidizing element is added when the receiving vessel is approximately ¼-full and the last deoxidizing element is added before the receiving vessel is full to allow thorough mixing and reaction time before the receiving vessel is full.

6. A method according to claim 1 in which the first deoxidizing element is added when the receiving vessel is approximately ¼-full and each subsequent deoxidizing element added at intervals of at least about 30 seconds.

7. A method of deoxidizing molten steel to minimize finely-dispersed non-metallic inclusions therein, comprising:

(a) refining a heat of steel in a steelmaking vessel, (b) slowly tapping said steel into a ladle such that the total tap time requires at least about 4 minutes, (c) after tapping has commenced and the ladle is approximately ¼-full, sequentially adding at least three different deoxidizing elements in order of increasing deoxidizing strength in a combined amount sufficient to deoxidize said heat of steel, allowing a sufficient time interval between additions to permit each addition to be mixed in and reacted.

8. A method according to claim 7 in which an interval of at least about 30 seconds is provided between each addition and the last addition is completed at least about 30 seconds before the ladle is full.

9. A method according to claim 8 in which said deoxidizing element and their order of addition comprise manganese, silicon and aluminum respectively.

10. In a process for producing a low-carbon electrical sheet steel wherein a molten heat of steel is formed into a slab, hot rolled, cold rolled and annealed, the improvement comprising deoxidizing the molten steel while it is being tapped into a ladle by sequentially adding at least three different deoxidizing elements to the ladle in order of increasing deoxidizing strength, said additions being spaced by a sufficient time interval to permit each addition to mix-in and react with oxygen and oxides therein.

11. A process according to claim 10 in which said time interval between additions is at least about 30 seconds, and the last deoxidizing element is added at least about 30 seconds before the ladle is full.

12. A method according to claim 10 in which said deoxidizing elements are, in the order of addition, manganese, silicon and aluminum.

13. A method for producing low-carbon electrical sheet steel having excellent magnetic properties comprising:

(a) forming a heat of molten steel containing not more than 0.02% carbon and not more than 0.015% sulfur;

(b) slowly tapping said steel into a receiving vessel;

(c) after the receiving vessel has been filled with a small amount of steel, adding manganese thereto in an amount sufficient to yield from 0.5 to 1.0% manganese in the final deoxidized steel;

(d) after allowing sufficient time for the manganese to mix-in and react with oxygen and oxides in the steel, adding silicon to the steel in the receiving vessel;

(e) after allowing sufficient time for the silicon to mix-in and react with the oxygen and oxides in the steel, adding aluminum to the steel in the receiving vessel, the combined amount of manganese, silicon and aluminum being sufficient to deoxidize said heat of steel;

(f) thereafter adding phosphorus to the receiving vessel in an amount sufficient to yield between 0.12 and 0.18% phosphorus in the final deoxidized steel;

(g) forming the above steel into a slab;

(h) hot rolling said slab to hot band gage with a finishing temperature within the range 1550° to 1600° F.;

(i) coiling said hot rolled steel at a temperature below 1050° F.;

(j) cleaning and cold rolling the steel to the final gage;

(k) annealing said steel to effect recrystallization; and (l) elongating the annealed steel.

14. A process according to claim 13 in which said annealed cold rolled steel is elongated from 7 to 9%.

15. A process according to claim 14 in which said elongation is effected by temper rolling.

16. A process according to claim 13 in which said manganese is added when the receiving vessel is approximately ¼-full, and a time interval of at least 30 seconds is provided between each addition.

17. A process according to claim 13 in which said silicon and aluminum are added in amounts sufficient to yield between 0.04 to 0.10% silicon and between 0.004 and 0.05% aluminum in the final deoxidized steel.

18. A process according to claim 13 in which said heat of steel contains more than 0.02% carbon, and the carbon thereafter reduced to a value no greater than 0.02% by solid state decarburization.

19. A method according to claim 13 in which said manganese addition is effected by adding electrolytic manganese.

20. A method according to claim 13 in which said manganese addition is effected by adding low-carbon ferromanganese.

21. A low-carbon electrical sheet steel having excellent magnetic properties consisting essentially of 0.5 to 1.0% manganese, 0.12 to 0.18% phosphorus, not more than 0.02% carbon and not more than 0.015% sulfur, said steel having been deoxidized while being tapped from the steelmaking vessel into a ladle by sequentially adding to the ladle first manganese, then silicon and thereafter aluminum, in a combined amount sufficient to deoxidize said steel, and at sufficient intervals between additions to permit each addition to mix-in and react with oxygen and oxides in the steel before the next addition is made, and thereafter hot rolling a slab of said steel to hot band gage with a finishing temperature within the range 1550° to 1600° F., coiling the hot rolled steel at a temperature below 1050° F., cleaning and cold rolling the hot rolled steel to final gage, annealing the cold rolled steel to effect recrystallization thereof, and elongating said steel, said steel at a thickness of 18.5 mils, characterized by 15 kilogauss core losses of from 2.3 to 3.15 watts/lb and permeabilities in excess of 2000.

22. A low-carbon electrical sheet steel according to claim 21 in which aluminum is within the range 0.004 to 0.05% and silicon is within the range 0.04 to 0.10%.

23. A low-carbon electrical sheet steel according to claim 22 in which said elongation is from 7 to 9% effected by temper rolling and characterized, at a thickness of 18.5 mils and at 15 kilogauss, by core losses of from 2.3 to 3.0 watts/lb.

* * * * *